United States Patent [19]

Berner

[11] 4,190,972

[45] Mar. 4, 1980

[54] SNOW REMOVER

[75] Inventor: John M. Berner, Minneapolis, Minn.

[73] Assignee: David H. Garven, Bloomington, Minn. ; a part interest

[21] Appl. No.: 807,375

[22] Filed: Jun. 17, 1977

[51] Int. Cl.[2] ..... E01H 5/00

[52] U.S. Cl. ..... 37/43 D; 37/53; 294/57; 294/58

[58] Field of Search ..... 37/43 R, 43 A, 43 B, 37/43 C, 43 D, 43 E, 43 F, 43 K, 43 L, 53; 15/410, 411, 144 A, 144 B, DIG. 10, 143 R, 143 A, 143 B, 144 R, 145, 79 R, 79 A, 22–27; 294/57, 58; 408/199, 204, 127, 124

[56] References Cited

U.S. PATENT DOCUMENTS

| | | | |
|---|---|---|---|
| 855,152 | 5/1907 | Wilson | 15/144 A |
| 1,207,386 | 12/1916 | Ferrer | 15/24 |
| 1,498,791 | 6/1924 | Field | 15/DIG. 10 |
| 1,672,250 | 6/1928 | Felton | 15/411 X |
| 1,787,696 | 1/1931 | McLaren | 15/DIG. 10 |
| 2,038,697 | 4/1936 | Winslow | 15/411 X |
| 2,039,860 | 5/1936 | Watts | 15/410 X |
| 2,821,258 | 1/1958 | Benson et al. | 15/410 X |
| 2,842,788 | 7/1958 | Rench et al. | 15/410 X |
| 3,051,459 | 8/1962 | Witzenburg | 37/43 R X |
| 3,074,189 | 1/1963 | Phelps | 37/43 D |
| 3,200,519 | 8/1965 | Kennedy | 37/43 R |
| 3,267,594 | 8/1966 | Mattson et al. | 37/53 X |
| 3,468,041 | 9/1969 | Mattson et al. | 37/43 E |
| 3,512,279 | 5/1970 | Benson | 37/43 R |
| 3,652,879 | 3/1972 | Plunkett et al. | 408/124 X |

FOREIGN PATENT DOCUMENTS

| | | | |
|---|---|---|---|
| 278894 | 2/1970 | Austria | 37/43 C |
| 143832 | 4/1961 | U.S.S.R. | 37/43 D |

*Primary Examiner*—E. H. Eickholt

*Attorney, Agent, or Firm*—Thomas A. Lennon

[57] ABSTRACT

The invention relates to a very light weight portable single stage snow remover which is electrically powered, can be operated and manipulated in a sideways swinging fashion in the manner of a broom, can handle normally difficult areas to clean such as steps and patios, can conveniently and easily be used in larger areas such as driveways and sidewalks, and can be pushed forward along the surface to be cleaned without having to swing the unit when forward movement is more desirable than sideward movement. The snow remover comprises a bladed rotor which operates within a housing and is rotated by an electric motor, the blades of the rotor throwing the snow rearwardly and upwardly against a snow collecting and directing wall which projects the snow in the direction desired. There is a direct drive relationship between the rotor and the motor and the entire motor-rotor housing is connected with a handle which is selectively adjustable relative to the direction of throw of the rotor and provided with a pair of hand grips to enable the unit to either be swung sideways in the manner of a conventional broom or pushed forward along the surface to be cleaned.

58 Claims, 10 Drawing Figures

SNOW REMOVER

There has long been a need for a small lightweight inexpensive snow remover, which need is progressively increasing because of our increasing urban population and our increasing numbers of people who live in townhouses and condominiums. The public has long had available to it the heavy duty two stage snow throwers in which an auger is driven by a gasoline engine, the auger feeding the snow to a fan which in turn blows the snow in the direction desired. These conventional types of snow throwers are very large, very heavy and very expensive and difficult to operate and manipulate. In fact, these conventional two stage snowthrowers are virtually impossible to be operated by old people, young people and those who are not very strong. Furthermore, these heavy two stage snow throwers are difficult to store and because they are difficult to store normally must be kept in cold environments such as garages and the like which in sub-zero temperatures often makes them difficult to start.

Furthermore, in the majority of the snow belt, the snow does not fall in exceedingly large amounts, normally not in excess of 4 inches in depth. Where these lighter snowfalls are involved, these heavy duty two stage units can be an unnecessarily oversized unit and there is a need for a lighter easier to handle device for this lighter type of snowfall.

With the expansion of urban and suburban living, the majority of the homeowners do not have a great deal of surface to be cleaned of snow, the surface to be cleaned oftentimes only being some steps and a sidewalk or maybe a small driveway for the average homeowner. As previously mentioned, there are increasingly large numbers of people occupying townhouses and condominiums where they have a small area to be cleaned which might consist of a patio or a small sidewalk. People in these circumstances are reluctant to invest in these aforementioned heavy duty two stage snowthrowers since, for the number of snowfalls involved in a season, the cost of the removal then becomes prohibitive. Furthermore, their size and difficult maneuverability make them impractical for these situations. Many of the areas where snow needs to be removed are of a nature where because of the difficulty of maneuverability of the heavy duty two stage units, the use of such a unit in these areas is either difficult or impossible depending on the circumstances.

Thus, there has long been a need for a lightweight snow remover which is easy to manipulate, inexpensive to buy, store, and which is capable of maneuvering in normally difficult areas which would be virtually inaccessable to a heavy duty two stage unit.

Furthermore, there are certain problems associated with gasoline engines, such as the usual hazards of having to store and use a combustible material such as gasoline, not to mention the inconvenience of periodically having to obtain gasoline and the various problems associated with cold weather, gas line freeze, etc. The problems of gasoline engines have further been accelerated recently by the shortages throughout the country and the world, placing distinct emphasis on the desirability of conserving energy.

In addition, most of the conventional and presently available snow removers have had the problem of lugging or torquing down as the load increases as the unit works through thicker, heavier or wetter snow, the resistance building to a point where the engine stops and stalls out, requiring restarting.

Therefore, the broad object of this invention is to solve all of the aforementioned problems. More specifically, one object of the invention is to provide a lightweight snow remover which is capable of being easily lifted, manipulated and operated by virtually everyone except extremely small infants. Another object is to provide a snow thrower which can be readily maneuvered in what would normally be inaccessable situations for larger two stage snow throwers and which can conveniently be used to clean off steps, stairways, etc.

Still another object is to provide a snow remover which is electrically powered to eliminate the problems associated with gasoline combustion engines.

An additional object is to provide a snow remover in which the performance characteristics of the motor will increase as the resistance increases to enable it to cope with varying situations which might be encountered in the course of a normal removal operation.

A further object is to provide a snow remover which is particularly effective for light snow falls, which can be conveniently stored indoors, and can even be hung on a wall, if desired.

Still another object is to provide a snow remover which is lighter and less expensive than any of the snow removers heretofore available capable of the same performance levels as the unit of the present invention.

Another object is to provide a snow thrower which can be selectively pushed straight ahead or swung from side-to-side to meet virtually every type of situation which the operator is likely to encounter.

Still another object is to provide an electrically powered snow thrower which has a uniquely designed cooling system for the motor which virtually eliminates any chance of moisture or snow reaching the motor.

A further object is to provide an electrically powered snow thrower having a direct drive system between the motor and the rotor thereby maximizing efficiency and minimizing the number of parts required and the number of things which can potentially go wrong or malfunction.

These and other objects and advantages of the invention will more fully appear from the following description made in connection with the accompanying drawings, wherein like character references refer to the same parts throughout the several views, and in which.

Figure 4:
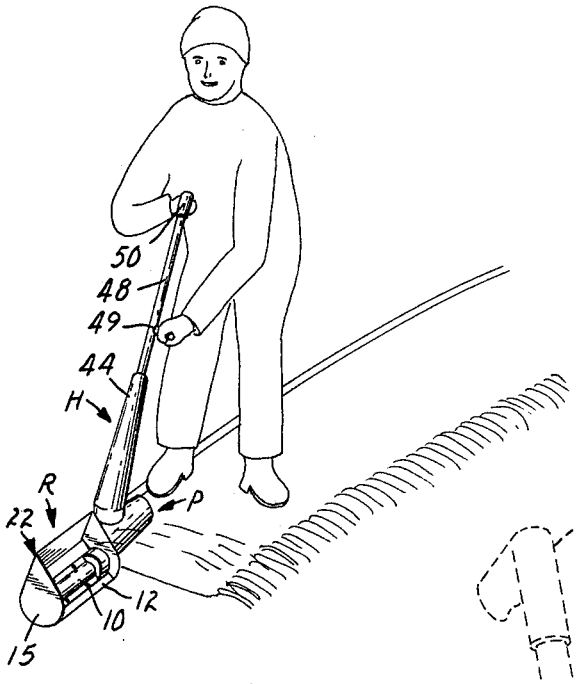
FIG. 4 is an illustrative view of the snow remover of FIGS. 1-3 in actual use with the operator using a side-to-side sweeping motion.

The unit disclosed comprises three basic parts, the rotor unit R, the power unit P and the handle unit H.

The rotor unit R includes an elongate hollow cylindrical rotor 10 which may be formed of any suitable lightweight material such as aluminum and on which is integrally formed pairs of diametrically opposed spaced apart blade holders 11 in which are mounted elongate snow removal paddles or blades 12 which are removably fastened thereto by fasteners 13. The paddles are preferably made of durable lightweight low friction plastic which endures repeated pounding on the surface and yet readily sheds the snow. The paddle holders may also be non-integral with the rotor, and be separate entities fastened to the rotor, such as pair of opposed spaced apart angle brackets. The rotor is concentrically mounted for rotation on an elongate spindle or shaft 14, which spindle in turn is supported at its opposite ends by the sidewalls 15 and 16 of the upper housing. One end (the outer end) of the spindle 14 has a reduced threaded end portion **14*a* which extends through an opening in the end wall 15 and is fastened to said end wall by means of a nut 17. The same outer end of said spindle is rotatably supported in a bushing 18 preferably formed of bronze, the bushing 18 and the rotor 10 being connected by a supporting end piece 19** which is secured to both of them.

The other or inner end of the rotor 10 is rotatably supported on the spindle 14 by means of a ball bearing unit 20, which in turn is held in place by means of a shouldered circular annular boss or collar 21 forming an integral part of the rotor 10. This same inner end of the spindle is supported by the power unit P in a manner described in more detail hereinafter.

The rotor unit R also includes a back wall 22, the lower end **22*a* of which is curved and formed on the arc of a circle having as its radius the center of rotation of the rotor 10. The extreme lower end of the curved wall portion 22*a* is downwardly offset at 22*b* to back and support a scraper blade 23 which is generally triangular in cross-section. The scraper blade is designed to move along and against the surface to be cleaned to scrape and lift the snow and sometimes ice from the surface to be cleaned. The upper part 22*c* of the rear wall 22 is straight and tangential to the lower curved portion 22*a***, and is tilted or inclined so as to overlie the major portion of the rotation diameter of the paddle assembly, so as to direct the snow upwardly and outwardly away from the rotor unit R.

The rear wall 22 is preferably made of a low friction plastic material to prevent the snow sticking thereto, and to maximize the effective distance of throw of the snow.

Figure 3:
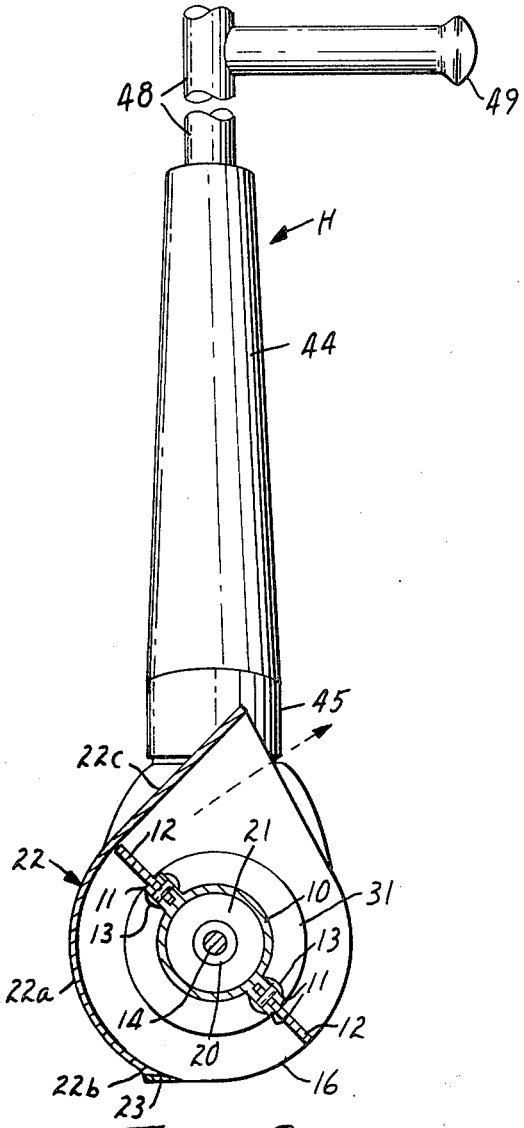
FIG. 3 is a cross sectional view taken along the lines 3—3 of FIG. 2.

The rotor 10 rotates in the direction of the broken line arrows seen in FIG. 3 with the paddles or blades 12 sweeping downwardly and rearwardly toward and against the scraper blade 23 picking up the snow collected on the scraper blade 23, and carrying it rearwardly against the lower rear wall **22*a* and then propelling it upwardly and outwardly along the wall portion 22*a* to the upper end 22*c* of the rear wall 22 to throw the snow high and far away from the area to be cleaned in the general direction of the broken arrow seen in FIG. 3**.

Attention is next directed to the power unit P, which unit includes an an annular hollow housing 24 which provides a chamber which substantially completely encloses and houses an electric motor 25 which is preferably of the universal type. One end of the motor is supported on a shaft 26 which is rotatably supported on a bracket 27 in a bushing 28. The motor drives a drive shaft 29 which is provided with pinion drive teeth or gear 30 on the outer end thereof. Rotor 10 has integrally formed therewith an annular circular driven gear 31 which has internal gear teeth 32 formed thereon which teeth 32 mesh with gear 30 whereby the rotor 10 is rotatably driven by the electric motor 25. The drive shaft 29 is supported by a supporting bracket 33 which is carried by the housing 24. Drive shaft 29 is also supported by a bushing 34 which in turn is supported by a collar 35 attached to the end wall 16 of the rotor housing. The housing 24 has an internal vertical end wall 36 which supports the internal end of the rotor spindle 14. The housing 24 has an outer wall 37 which is provided with air holes 38 for passage of air through the interior of the housing 24 to keep the motor cool during operation. The upper side of the housing 24 is provided with an opening 39, which opening 39 is surrounded by an annular circular upstanding boss 40 on which the handle unit H is mounted, the boss 40 being formed integrally with the motor housing 24. The boss 40 has an inwardly offset ring or ledge 41 defining an opening 42 in the upper end of said boss 40, whereby cooling air for the motor is admitted through said boss and the upper opening 39 to the motor housing 24. The power unit housing 24 may also be supported by a skid member 43 if so desired.

The handle unit H includes an elongate tubular housing 44, the lower end of which terminates in a cylindrical portion 45 which is mounted on and rotatably encircles the upstanding boss 40 to enable the handle to rotate thereon and to be selectively adjustable relative to the rotor and power units for selective pushing or sweeping motion of the rotor housing. The handle housing 44 includes an inwardly extending circular ring or ledge 46 which is formed integrally therewith, said ring 46 resting and riding on ring 41 of boss 40 and defining an opening 47 for admitting cooling air for the motor into the boss 40 and motor housing 24.

The upper end of the handle unit H includes a rod 48 on which is mounted a lower handle grip 49 and an upper handle grip 50. Handle 50 houses a plug 51 connected to an electrical cord 52, which is connected with the electric motor 25 whereby by connection to a suitable outlet the electric motor can receive the electricity necessary to drive same.

A releasable latch or member 53 is slidably supported on one side of the handle housing 44 by member 54, said lock member having a manually operable handle 55 for selectively lifting the member to lock and unlock the handle. This enables the handle to be locked in any position desired. The lower end of the latch 53 seats in recesses 56 formed in the motor housing 24, and is disengaged or unlocked by lifting latch 53 out of seated engagement with the respective recess.

The upper underside of the handle housing 44 is provided with air inlet openings 57 for admitting cooling air to the interior of handle housing 44, whereupon the air travels downwardly through said handle housing and boss 40 into motor housing 24, it is ultimately discharged through openings 38 in the end after passing over and cooling the motor. The openings 57 are located in an area high enough and remote from the snow being thrown about so that no snow or water reaches the electric motor. The parts connected with the motor housing are in sealing relationship therewith so that the entire motor housing is protected from moisture. In order to limit the rotational movement of the handle unit so that it stops at the desired operational position, the boss 40 is provided with a circumferentially oriented slot in which rides a limit bolt 58, the ends of the slot against which the bolt 58 comes to rest defining the desired position of the handle.

Figure 1:
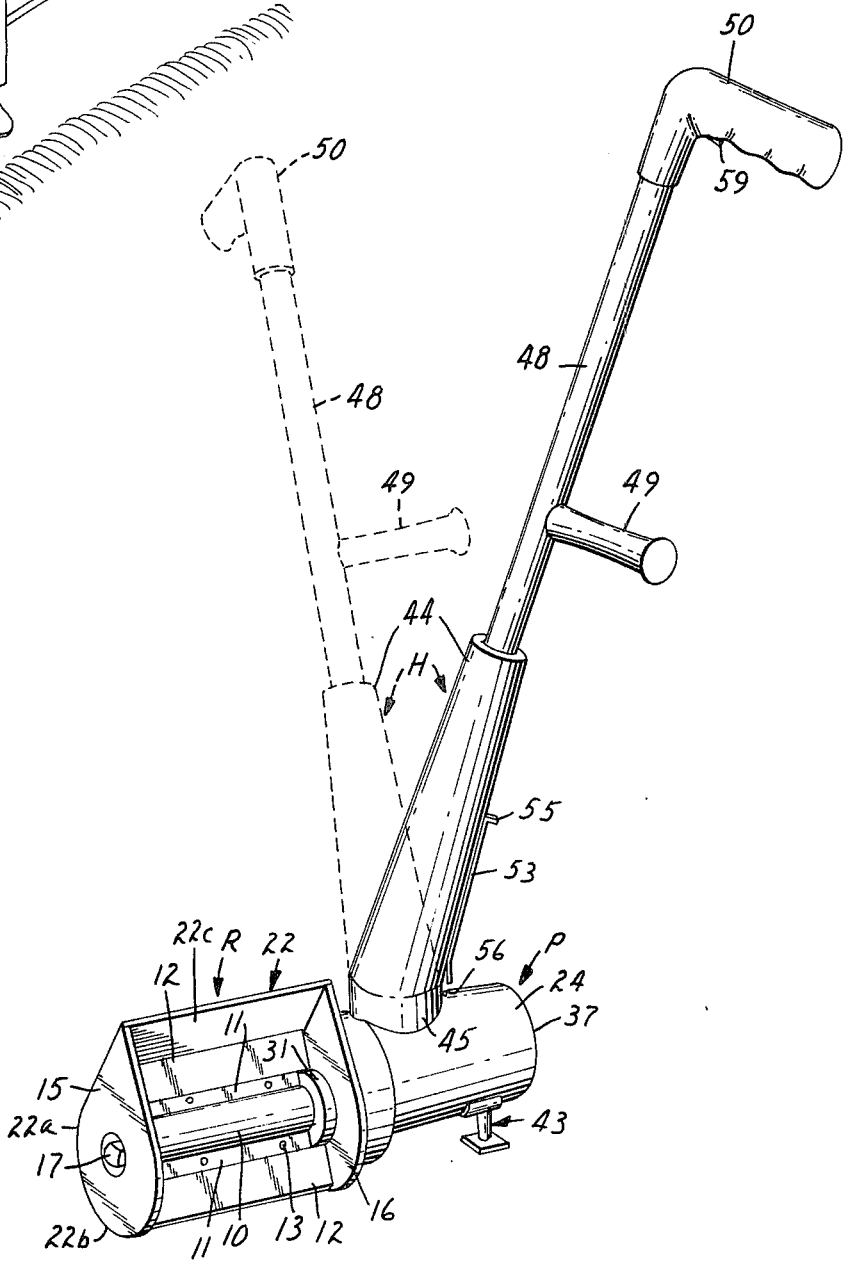
FIG. 1 is a perspective view of a snow remover constituting one preferred embodiment of this invention.
Figure 2:
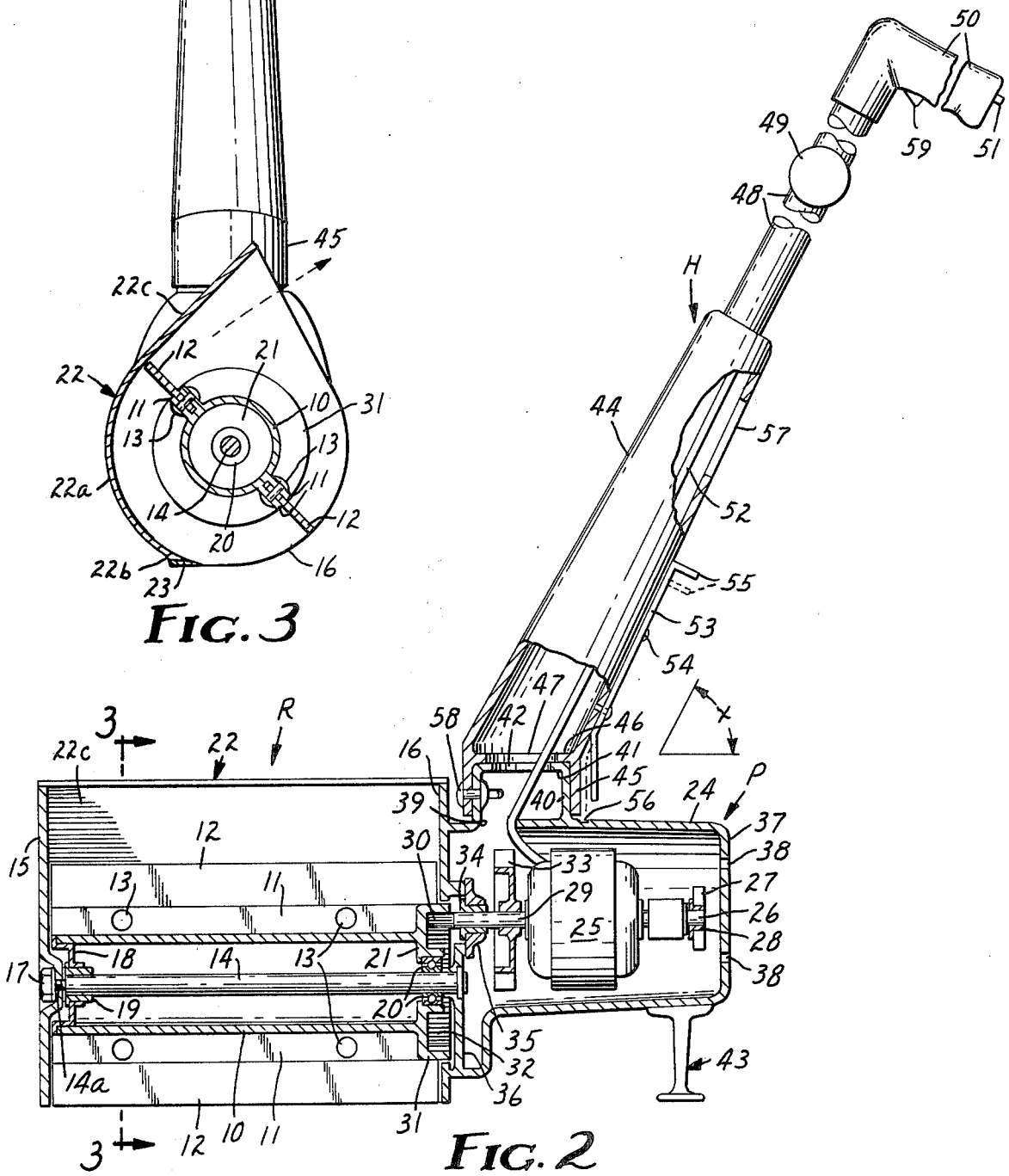
FIG. 2 is a front elevation view of the snow remover shown in FIG. 1, with portions broken away for clarity.
Figure 5:
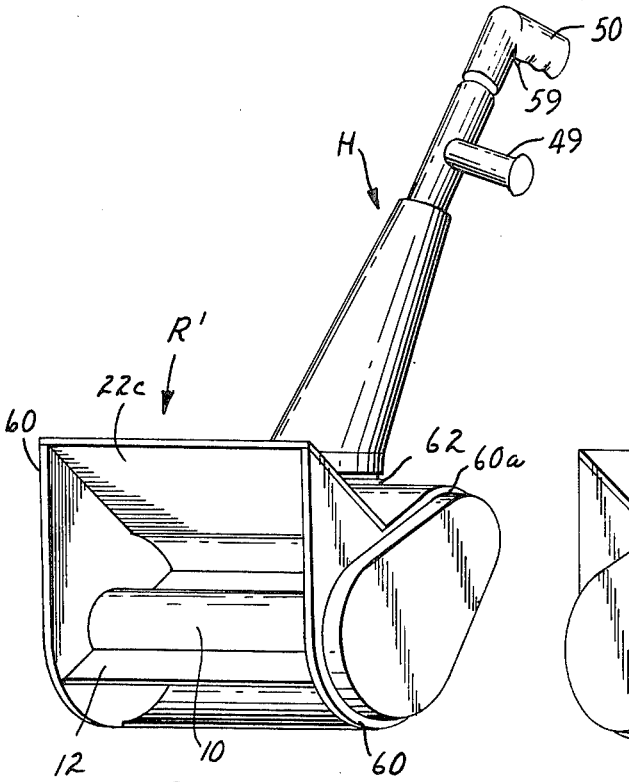
FIG. 5 is a left front perspective view of an alternate form of snow remover of this invention in which the motor is mounted behind the rotor.
Figure 6:
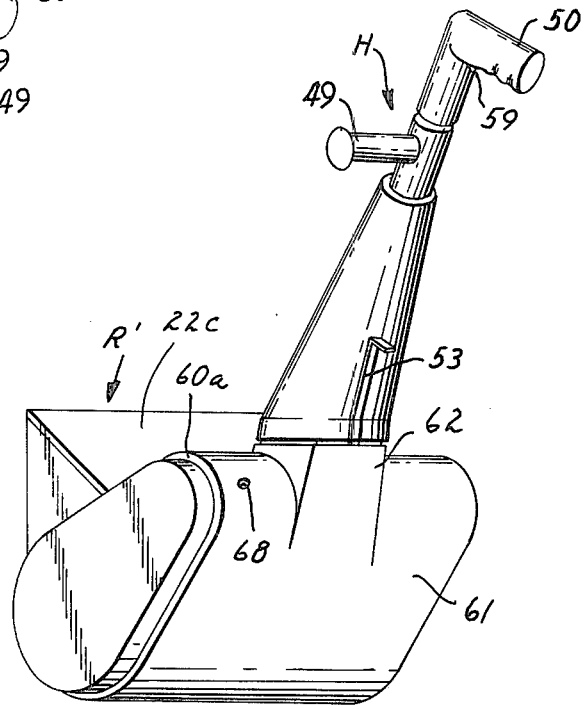
FIG. 6 is a left rear perspective view of the snow remover of FIG. 5.

In the view shown in FIG. 2, it will be noted that the handle is at an angle other than perpendicular with respect to the rotor housing and the motor. It is preferred that this angle X be between 30° and 75° with respect to the horizontal to provide the most effective use of this snow remover with an angle of approximately 60° being generally the most preferred angle for most applications. In the position shown in FIG. 2, the unit is designed to be swung back and forth in a sweeping motion by the operator in much the same manner as one would swing a broom when sweeping. If it is desired to push the unit rather than swing same, then the handle is moved 90° to the broken line position shown in FIG. 1, by rotating same relative to the power unit housing so that the handle extends rearwardly behind the rotor housing in a direction opposite to the direction in which the snow is thrown.

This dual positioning of the handles enables the snow remover to be used effectively in almost any situation. In the position shown in FIG. 2 and the solid line position of FIG. 1, the longitudinal axis of the handle lies in a plane which is parallel to the axis of rotation of the rotor, and in the version illustrated are substantially co-planar, with said plane of the handle being perpendicular to the direction of movement and throw of the rotor unit. This enables the snow to be thrown to the side of the operator and laterally with respect to the direction of movement of the operator.

In alternate broken line handle position of FIG. 1, the longitudinal axis of the handle lies in a plane which is perpendicular to the axis of rotation of the rotor, and parallel to the direction of movement and throw of the rotor housing and movement of the operator to faciliate pushing the unit through the snow ahead of the operator.

The handle grips 49 and 50 are disposed at right angles to each other to facilitate both the pushing and sweeping movement of the rotor unit. The lower handle 49 is adjustable to either side to facilitate use by both right and left handers.

An example of one successful snow remover made substantially similar to that illustrated in FIGS. 1 through 4 weighed approximately 9 pounds. The rotor had an effective circle of rotation of 6 inches in diameter and a length of 9 inches. The universal motor had a rating of 6 amps. The handle length was 42 inches, measured from the ground to outer tip, and it could throw the snow about 8 feet.

The discovery that a universal motor has an unexpectedly unique application in the snow thrower field solves many problems heretofore associated with powered snow removers. Every powered snow remover experiences peak demands and surges in the load requirements, resulting in lugging down of the rotor unit and stalling of the motor. However, the operating characteristics of a universal motor are such that it has a very high torque at low rpm, enabling it to continue to operate efficiently even during those peak periods when the heaviest, wettest and thickest snow is being plowed.

FIGS. 5 to 8 illustrate an alternate form of the invention in which the power source is mounted rearwardly or behind the rotor unit, rather than in endwise relationship therewith as in the previously described form of the invention illustrated in FIGS. 1 to 4.

The snowthrower of FIGS. 5 to 8 includes a rotor unit R′ which is essentially the same as rotor unit R, the rotor 10, the backwall 22, and blades on paddles 12 being the same. The side walls 60 are modified in design to include end wall portions **60*a*** to enclose the ends of the motor housing.

The same motor 25 can be used in this alternative form, and it is mounted behind and above the rotor 10 and rearwardly of back wall 22, with the axis of rotation of its armature shaft 26 being parallel to the axis of rotation of the rotor 10. The motor is housed within a second rear wall 61, the sides of which abut with the end of the rotor unit R′.

A handle support or boss 62 is integrally formed with the back wall 61, and functions in the same manner as boss 40 of the first described unit to support the same handle unit H for rotation about a vertical axis, with the interface between the handle unit and bars 62 providing a horizontal plane of pivot for the handle unit. It will be understood that in each of the illustrated and described versions, the handle angle remains the same with respect to the vertical and horizontal, regardless of which operative position it is turned to.

Figure 7:
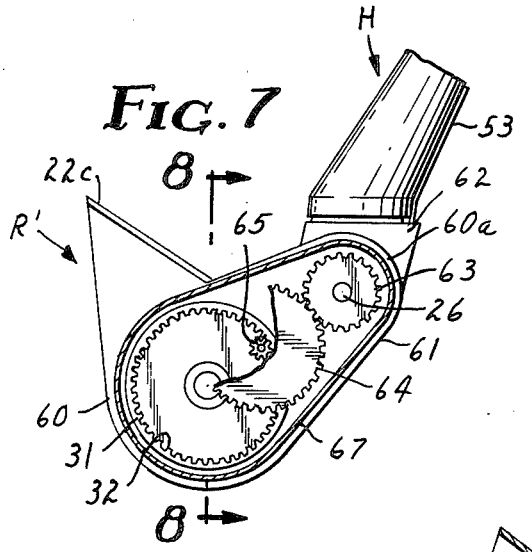
FIG. 7 is a side elevation view of FIGS. 5 and 6, with portions broken away.
Figure 8:
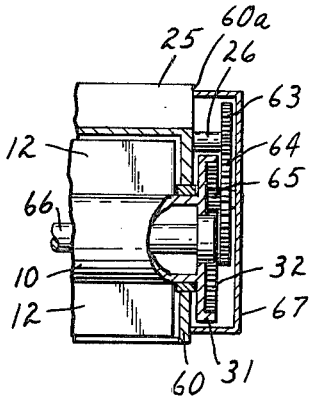
FIG. 8 is a cross-sectional view taken along the line 8—8 of FIG. 7.

Because of the change in the relative positions of the motor and rotor, transmission means must be provided between them, and this transmission means is best seen in FIGS. 7 and 8. The transmission means includes a drive pinion 63 mounted on and driven by the motor armature shaft 26. The pinion 63 in turn is in driving engagement with a larger intermediate gear 64 which in turn concentrically supports and drives another pinion gear 65, which in turn is drivingly engaged with the internal gear 31 which is drivingly connected to the rotor 10. Gears 64 and 65 are supported by a spindle 66 which in turn is supported by a gear cover 67 which in turn is supported by side walls 60 and **60*a*** in any suitable manner.

This alternate design still provides all the advantages of the earlier described design of FIG. 1, including the ability to utilize a sweeping action to either side of the direction of travel, or to throw it straight ahead by simply adjusting the handle relative to the rotor housing. The motor is also elevated from ground level, thereby reducing the chances of being exposed to moisture such as snow or water. The back wall 61 of the motor housing is provided with openings 68 to permit exhausting air from the motor housings, and they function in the same manner as the air holes 38 of FIG. 1, thereby permitting cooling air to be drawn through the handle unit and across the motor to keep the motor cool during operation.

It is to be understood that in the alternate form of FIGS. 5 through 8 inclusive, the handle unit H is identical in construction to the handle unit of FIGS. 1 through 4 with one minor modification and is noted herafter coupled to the supporting power unit in the same manner. Since the details of construction are the same, another detailed sectional view is deemed unnecessary.

Thus, the handle unit of FIGS. 5 through 8 has an upstanding cylindrical boss corresponding to boss 62 of its power unit, and a depending cylindrical portion, skirt or flange corresponding to the cylindrical portion 45 of FIG. 2 which cooperates or mates with the upstanding boss 40, to not only connect the handle unit to the power unit but also to provide a pivot connection to enable the handle unit H to pivot about a vertical axis defined by the vertical center lines of members 40 and 45 between various operative positions. The minor modification referred to above is in the length of the guide slot in boss 40 in which the limiting bolt 58 rides. In FIGS. 5 through 8 the slot is longer to enable the handle to swing through 180 degrees of movement, rather than the 90 degrees of movement of FIGS. 1 through 4. This enables the operator to adjust the handle so that the rotor unit R' faces either to his left or his right, as desired for swinging, sweeping movement, as well as directly ahead (as in FIGS. 5 and 6) for pushing movement. Thus, the handle can be swung 90 degrees to the right or the left of the handle position shown in FIGS. 5 and 6.

In each of the handle units of this invention, it is preferred that the depending member 45 be the female or outside portion of the connection, and that the upstanding member 40 be the male or inside portion of the connection, to prevent liquid from entering the motor housing through the pivot connection. It can be readily seen that in this design shown, the skirt 45 sheds water and prevents it from getting into boss 40 and the motor housing.

Figure 9:
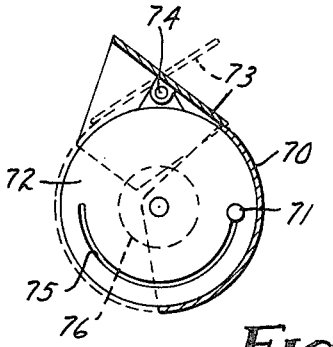
FIG. 9 is an illustrative side view of still another alternate form of this invention.

Still another form of the invention is shown somewhat illustratively in FIG. 9, in which the rotor housing is designed to be flipped from side to side to facilitate changing the direction of the throw.

In this version, the back wall 70 of the rotor housing is slidably supported at each end by the end walls 72 of the rotor housing. Each end wall 72 is provided with a semi-circular slot 75 in which rides a pin 71 connected with the back wall 70 in any suitable manner, the pins 71 being provided with a fastener such as a wing nut (not shown) to lock it in place. Thus, by loosening the fasteners, the back wall 70 can be slid from the solid line position of FIG. 9 to the diametrically opposite broken line position of FIG. 9 in which it faces in the opposite direction. To prevent premature dispersal of the snow and control the angle of throw of the snow, an extension plate or wall member 73 is provided, which is held by a pivot pin 74 so that it can be tiltably adjusted from the solid line position of FIG. 9 in which it would direct the snow to the left (as viewed in FIG. 9) to the broken line position of FIG. 9, in which it would direct the snow to the right (as viewed in FIG. 9). The top 73 of the housing is, in effect, a two-way plate, capable of mating with either end of the backwall 70 regardless of which direction the rotor housing is facing. In this version, the motor 76 is a reversing motor which can selectively rotate in either direction to adjust to the direction of throw desired.

Figure 10:
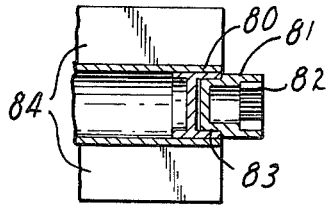
FIG. 10 is a partial sectional view of still another alternate form of this invention.

FIG. 10 illustrates still another form of the invention, involving a snow remover with clutch means for operating by disconnecting the rotor from the drive system in the event it gets overloaded by snow or gets an object stuck between the rotor blades and the housing which inhibits movement.

In FIG. 10, a portion of a rotor unit is shown which includes a cylindrical rotor 80 on which are mounted the snow collecting and throwing paddles or blades 84. A cylindrical driven hub 81 is cooperatively installed in one end of the rotor 80 with an interference fit or a tight slip fit between the rotor 80 and the hub 81 to provide a clutching surface 83 therebetween. The hub 81 is also provided with internal gear teeth 82 to be driven by the drive pinion 30 on the motor shaft in the manner hereinbefore described. Under normal circumstances, the power will be transmitted from the pinion 30 to the hub 81 through the clutching surface 83 at the circular interface between the hub 81 and the rotor 80, thereby turning the rotor and the blades 84 carried thereon. However, if the blades encountered too much snow for the motor to handle, or if some foreign object such as a stone or stick gets stuck between the blades and the housing, the hub 81 will slip relative to the rotor 80, thereby preventing stalling of the engine and possible damage thereto or to the drive system components until the overloading is corrected or the foreign object is removed.

If the clutch of FIG. 10 is not used, one preferred version of the invention, such as that illustrated in FIG. 2, involves having the internal gear 31 and its teeth 32 molded integrally with the rotor 10 as a single integral member, thus simplifying manufacture and minimizing cost.

The clutch form of the invention shown in FIG. 10 also facilitates another inventive concept of this invention, namely the concept of preassembling the rotor and blade assembly to at least the outer end wall and back wall of the rotor housing, which preassembled unit would then be joined to the motor housing at some later point in the overall assembly process. In such a situation, thr rotor 80 with its blades 84 would be preassembled with an outer end wall corresponding to 22. A motor housing corresponding to 24, with a motor corresponding to 25, a shaft corresponding to 29, a pinion corresponding to 30, and a hub corresponding to 81 with internal teeth 82 can be preassembled as a unit and then fastened or otherwise connected to the aforedescribed rotor, blade, and rotor housing preassembly unit in any suitable manner.

The supporting structure of FIG. 2 also is adaptable to this preassembly procedure. In this version, the rotor assembly including the rotor 10 with its integrally molded internal gear 31 and its teeth 32 and the blades 12 mounted thereon, and its spindle 14 and bearings 20 would be preassembled with the outer end wall 15 and back wall 22. Another preassembled unit of FIG. 2 would be the motor housing 24 with its motor 25, shaft 29, and pinion 30, and collar 34, and inner wall portions 36 and 16. This second preassembled unit would then be assembled with the first mentioned preassembled unit involving the rotor by securing the wall structure of the motor housing to the back wall 22 by suitable fastening means, installing the inner end of the spindle 14 in the opening provided in wall portion 36, and placing the pinion 30 in driving engagement with internal teeth 32.

It is also desirable to form the internal gear 31 and its teeth from plastic material as an insulation factor, therby providing a double insulated unit.

It will also be understood that the handle unit can be designed so as to be locked in a variety or multiplicity of positions other than the positions illustrated and/or described within the scope hereof.

Other advantages of the snow remover of this invention include the fact that it is non-polluting, and less costly to operate than a gas driven unit in those areas where the cost of gas has become excessive. The snow remover is useful in shaving high drifts as much as four to six feet high such as those that develop along fences and is also useful in shaving snow off along the edges of the roof on a house. The snow remover is also quieter and easier to start than gasoline models, and is healthier than currently available snow removers because of its easy starting and the light weight which minimizes strain and potential heart attacks and back problems.

In operation, the handle unit is positioned relative to the rotor unit, and locked in place by manipulation of the latch 53. If a long narrow sidewalk is to be cleared, the handle unit H and rotor unit R will be positioned as in FIGS. 1 and 4, the cord will be plugged into a source of electricity, and the operator will grip the handle grip 49 with one hand and the handle grip 50 with the other hand, and begin to clear the walk with a swinging or sweeping movement such as that illustrated in FIG. 4. In wider areas such as driveways, it may be better to push, rather than swing, in which case the handle is adjusted to the broken line position of FIG. 1. In the pushing style, the snow is thrown ahead of the operator in the direction of travel. In the swinging or sweeping style, the snow is thrown to the right or left of the operator at right angles to the general direction of travel of the operator. Regardless of style of operation, the snow is gathered by the paddles 12 and thrown rearwardly and upwardly against the back wall 22 and directed away from the remover and operator by the upper inclined wall portion 22c. The scraper blade rides along the surface to be cleaned, directing snow upwardly along the rear wall, and scraping loose compacted snow and ice from the surface to be cleaned. The lower handle grip 49 may be designed so as to swing through 180° of movement on its supporting rod and locked in either the position illustrated or in a diametrically opposite position to facilitate use by either right or left handed people. It will of course be understood that various changes may be made in form, details, arrangements, and proportions of the various parts without departing from the scope of this invention.

I claim:

1. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said tool means having a mounting means upon which said handle means is mounted to be movable relative to said tool means about a vertical axis between a first position in which said axis lies in a plane which parallels said operational direction and a second position in which said longitudinal axis lies in a plane which is substantially perpendicular to said operational direction, said longitudinal axis being offset in angular relationship with respect to said vertical axis, said handle means being immovable relative to said tool means about a horizontal axis, and releasable latch means holding said handle means against movement relative to said tool means in each of said positions.

2. The device of claim 1, wherein said handle means includes two handle grips, the longitudinal axis of one grip lying in a plane substantially parallel to said predetermined operational direction when said handle means is in said first position, the longitudinal axis of the other of said handle grips lying in a plane substantially perpendicular to said predetermined operational direction when said handle means is in said first position.

3. The device of claim 1, wherein said device is a ground traversing device, said handle means being movable relative to said tool means about said vertical axis when said device is in normal operative ground supported position.

4. The device of claim 1 wherein said powering means includes motor means; and including means for conveying air to said motor means from a location remote from said motor means.

5. The device of claim 1, wherein said tool means includes a rotatable member and said powering means includes a motor and a motor shaft, the axis of rotation of said shaft being parallel to the axis of rotation of said member, and gear means interposed between said member and shaft whereby said member is rotatably driven by said shaft.

6. The device of claim 5, wherein said tool means includes a rotatable member and said powering means includes a motor and a motor shaft, and wherein said gear means includes an annular gear member drivingly connected to said rotatable member and having internal gear teeth on the inner face thereof, said gear means also including a pinion gear carried by said shaft and driven thereby, said pinion being in driving engagement with said internal gear teeth.

7. The device of claim 6, wherein said gear means includes a first gear member drivingly connected to said rotatable member, a second gear member carried by said shaft and driven thereby, and a third gear member interposed between and engaged with said first and second gear members.

8. The device of claim 1, wherein said powered tool means includes a rotatable member whose axis of rotation is perpendicular to said predetermined operational direction.

9. The device of claim 1, wherein said tool means is designed for surface traversing movement in said predetermined operational direction by manual manipulation of said handle means, said tool means including means for gathering material from said surface while traveling in said operational direction.

10. The device of claim 1 wherein said tool means is designed for surface traversing movement in said predetermined operational direction, said tool means including means for gathering material from said surface while traveling in said operational direction, said material gathering means rotating about an axis perpendicular to said direction.

11. The device of claim 1, wherein said tool powering means includes a universal electric motor, and said device is a snow remover.

12. The device of claim 1, wherein said handle means includes two elongate grip portions, said grip portions lying in planes perpendicular to each other, and wherein said device is a snow remover.

13. The device of claim 1, wherein said tool means is adapted to gather snow from a surface and throw it a substantial distance therefrom, and wherein said handle means is elongate and has an upper distal end remote from said tool means behind which the operator normally stands and a lower proximal end closer to said tool means than said distal end whereby said handle means is inclined downwardly and forwardly of said operator when positioned behind said distal end, said longitudinal axis forming with the horizontal an acute angle which faces the operator when positioned behind said distal end.

14. The device of claim 13, where said acute angle in between 30° and 75° with respect to the horizontal.

15. The device of claim 1, wherein said powering means is enclosed by housing structure, said tool means including a rotatable element whose axis of rotation is perpendicular to said operational direction, said housing structure being in general alignment with said axis, said rotatable element supporting snow gathering blades and including wall structure for receiving the snow from said blades and directing it a substantial distance away from said device.

16. The device of claim 1, comprising a rotor housing including a pair of spaced apart opposed end walls and a rear wall with a material receiving opening opposite said rear wall, material gathering means including a rotor rotatably mounted between said end walls and adapted to gather material presented to it from said receiving opening and propel it rearwardly and upwardly along said rear wall, electric motor means operatively connected with said material gathering means for rotating same, said longitudinal axis of said handle means lying in a plane generally perpendicular to said rear wall in said first position and in a plane generally parallel to said rear wall in said second position.

17. The device of claim 16, including housing means enclosing said motor, means for admitting air to said housing which encloses said motor from a source remote from said motor housing means.

18. The device of claim 17, wherein said handle means includes elongate conduit means in communication with the interior of said motor housing, said conduit means extending generally upwardly from said motor housing and drawing said air from a source above and remote from said motor housing.

19. The device of claim 16, including a housing enclosing said motor, said motor housing being disposed in general alignment with said end walls.

20. The device of claim 19, wherein said handle means is connected to and supported by said motor housing.

21. The device of claim 16, including a housing enclosing said motor, said motor housing being disposed behind said rear wall.

22. The device of claim 21, wherein said handle means is connected to and supported by said motor housing.

23. The device of claim 1, including gear means for transmitting power from said powering means to said tool means, said tool means including a rotatable member, said gear means including a gear integrally formed with said rotatable member.

24. The device of claim 1, including means for transmission of power from said powering means to said tool means, said tool means including a rotatable member which rotates about a given axis, the longitudinal axis of said handle means in said first position lying in a plane substantially perpendicular to said axis of rotation and in said second operational position lying in a plane substantially parallel to said axis of rotation.

25. The device of claim 1, including transmission means for the transmission of power from said powering means to said tool means, said transmission means including clutch means having two opposed cooperating clutching surfaces in slip fitting relationship to each other.

26. The device of claim 1, wherein said tool means includes a first preassembled unit which includes a rotor and an end wall supporting one end of said rotor, and a back wall, and said powering means includes a second preassembled unit which includes a motor, a motor housing, and a motor shaft, said preassembled units being fastened together whereby said motor means is in driving relationship with said rotor.

27. The device of claim 1, wherein said handle means is also movable relative to said tool means between said second position and a third position in which said longitudinal axis lies in a plane substantially perpendicular to said operational direction, said second and third positions being substantially diametrically opposite each other requiring movement of said handle means through approximately 180° of movement between said second and third positions, said latch means also being effective to hold said handle means relative to said tool means in said third position.

28. The device of claim 1, wherein said handle means includes two handle grips, the longitudinal axis of one grip lying in a plane substantially parallel to said predetermined operational direction, the longitudinal axis of the other of said handle grips lying in a plane substantially perpendicular to said predetermined operational direction when said handle means is in either of said first or second positions.

29. The device of claim 1, wherein said tool means includes a tool member rotatable about a fixed axis, said tool member having a first gear member drivingly engaged therewith, an electric motor mounted rearwardly of said tool member with respect to said operational direction, said motor having a motor shaft whose axis parallels that of said first gear member, a second gear mounted on and driven by said motor shaft, a third gear engaged with said second gear and driven thereby, and a fourth gear coaxial with and driven by said third gear, said fourth gear being drivingly engaged with said first gear member which in turn drives said tool member.

30. The device of claim 29, wherein said first gear is a circular gear member coaxial with the axis of said tool member and wherein said fourth gear is a circular gear smaller in circumference than said third gear which is also circular, said third and fourth gears having teeth on the outer circumference thereof.

31. The device of claim 29, wherein said tool includes a rotor and wherein said first gear is integrally formed with said rotor.

32. The device of claim 1, wherein said device is powered by an electric motor, a motor housing enclosing said motor, an opening in said motor housing for admitting air to the interior thereof, said handle means being mounted on said motor housing for movement relative thereto between said operative positions, said handle means being tubular and extending upwardly from said motor housing with the interior passageway thereof in communication with said opening for the passage of air from said passageway through said opening to the interior of said motor housing to cool said motor, and an opening in the upper end portion of said handle means for admitting air to said passageway.

33. The device of claim 32, including an electric cord extending through said passageway and opening in the motor housing and operatively connected with said motor for providing electricity thereto to operate same.

34. The device of claim 1, wherein said powering means comprises an electric motor, a housing for said electric motor substantially completely enclosing said motor, a first opening in said housing for admitting air thereto, and a second opening in said housing for discharging air therefrom, said openings being positioned relative to said motor whereby said air when passing from said first to said second opening passes over and cools said motor.

35. The device of claim 34, including means for drawing said air from a source remote from said housing.

36. The device of claim 34, wherein at least a portion of said handle means is tubular, one end of said tubular portion being in communication with said first opening for delivering air from said tubular portion to said first opening, said tubular portion having an opening therein more remote from said first opening than said aforementioned end of said tubular portion for admitting air into said tubular portion for ultimate delivery to said housing.

37. The device of claim 34 wherein said mounting means comprises a mounting member having one end in communication with said first opening the other end being circular and facing generally upwardly, said handle means having a circular portion outwardly enclosing and receiving said other end portion of said circular member and preventing liquid from entering said circular member, said circular portion of said handle means being rotatable relative to said mounting member to permit the movement of said handle means between said first and second positions.

38. The device of claim 1, wherein said device is a snow thrower, said tool means including a rotor housing including a pair of spaced apart opposed end walls and a rear wall with a material receiving opening opposite said rear wall, snow gathering means including a rotor rotatably mounted between said end walls and adapted to gather snow presented to it from said receiving opening and propel it rearwardly and upwardly along said rear wall, an electric motor operatively connected with said rotor for rotating same, a motor housing substantially completely enclosing said motor, a housing for said electric motor, substantially completely enclosing said motor, a first opening in said housing for admitting air thereto, a second opening in said housing for discharging air therefrom, said openings being positioned relative to said motor whereby said air when passing from said first to said second opening passes over and cools said motor, and wherein at least a portion of said handle means is tubular, one end of said tubular portion being in communication with said first opening for delivering air from said tubular portion to said first opening, said tubular portion having an opening therein more remote from said first opening than said aforementioned end of said tubular portion for admitting air into said tubular portion for ultimate delivery to said housing, and wherein said mounting means comprises a mounting member having one end in communication with said first opening the other end being circular and facing generally upwardly, said handle means having a circular portion outwardly enclosing and receiving said other end portion of said circular member and preventing liquid from entering said circular member, said circular portion of said handle means being rotatable relative to said mounting member to permit the movement of said handle means between said first and second positions.

39. A powered device comprising supporting structure, powered tool means supported by said structure having a predetermined operational direction with respect to its own operative components and structural design, means supported by said structure for powering said tool means, and handle means supported by said structure manually directing the movements of said structure, said handle means being movable relative to said tool means, wherein said tool means is adapted to gather snow from a surface and throw it a substantial distance therefrom, and wherein said powering means is enclosed by housing structure, said housing structure having an opening for admitting air to the interior of said housing structure and an opening for discharging air from the interior of said housing structure, said housing structure having first annular wall means circumscribing said air admitting opening, said handle means having second annular means cooperatively engaged with said first annular means and providing a pivotal connection between said handle means for pivotal movement of said handle means relative to said housing structure and tool means, said handle means including conduit means for conveying air from a location remote from said housing structure through said first and second annular means and said air admitting opening into the interior of said housing structure.

40. The device of claim 39, wherein said handle means is pivotal between operational positions, and including latch means for releasably holding said handle means against movement in each of said operational positions.

41. The device of claim 39, wherein said handle means pivots about a vertical axis with respect to said tool means when said tool means is in normal ground supported operating position.

42. The device of claim 39, wherein said device is a snow thrower, and said tool powering means includes a universal electric motor.

43. A powered device comprising supporting structure, powered tool means supported by said structure having a predetermined operational direction with respect to its own operative components and structural design, means supported by said structure for powering said tool means and, handle means supported by said structure for manually directing the movements of said structure, said handle means being movable relative to said tool means, said device comprising a rotor housing including a pair of spaced apart opposed end walls and rear wall with a material receiving opening opposite said rear wall, an elongate rotor rotatably mounted between and supported by said end walls for rotation about its longitudinal axis, paddle means mounted on said rotor for gathering material and propelling it rearwardly and upwardly along the face of said rear wall, an electric motor mounted rearwardly of said rear wall and having a motor shaft parallel to the axis of rotation of said rotor, transmission means interposed between said motor shaft and rotor to enable said motor to drive said rotor, a motor housing enclosing said motor, and connecting with said rotor housing, an opening in the top portion of said rotor housing for admitting air to the interior thereof, first wall structure carried by said motor housing and second wall structure carried by said handle means, said first and second wall structure being cooperatively engaged to support said handle means on said motor housing, said second wall structure being rotatable relative to said first wall structure to enable said handle means to swing between said first and second operative positions, latch means for releaseably holding said handle means in each of said operative positions, at least a portion of said handle means being tubular and extending upwardly from said motor housing, an opening in the upper end of said handle portion to admit air thereto, said tubular portion being in communication with said opening in said motor housing to deliver said air thereto.

44. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, said handle means including first and second elongate handle grips, the longitudinal axis of said first grip lying in a plane substantially parallel to said predetermined operational direction when said handle means is in said first operational position and lying in a plane substantially perpendicular to said predetermined operational direction when said handle means is in said second operational position, the longitudinal axis of said second grip lying in a plane substantially perpendicular to said predetermined operational direction when said handle means is in said first operational position and being substantially parallel to said predetermined operational direction when said handle means is in said second operational position.

45. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, and wherein said device is a ground traversing device, said handle means being adapted for pivotal movement relative to said tool means about a substantially vertical axis when said device is in normal operative ground supported postion and wherein said handle means supports conduit means for conveying air to said powering means from a location remote from said powering means.

46. The device of claim 45, wherein said device is a snow thrower and said tool powering means includes a universal electric motor.

47. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, and wherein said tool means is designed for surface traversing movement in said predetermined operational direction, said tool means including means for gathering material from said surface while traveling in said operational direction, said tool means also including wall means adapted to receive material from said gathering means and direct it generally upwardly and outwardly in said operational direction, said gathering means being adapted to propel the gathered material against and upwardly along the face of said wall means, said wall means being shiftable to a second operational position in which it is capable of throwing gathered material upwardly and outwardly in a direction directly opposite to said operational direction, means for reversing the direction of movement of said gathering means when said wall means is in said second operational position so as to gather material from the surface being traversed and propel gathered material against and upwardly along the face of said wall means in said second operational position.

48. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, and comprising a rotor housing including a pair of spaced apart opposed end walls and a rear wall with a material receiving opening opposite said rear wall, material gathering means rotatably mounted between said end walls and adapted to gather material presented to it from said receiving opening and propel it rearwardly and upwardly along said rear wall, electric motor means operatively connected with said material gathering means for rotating same, said handle means in said first operative position having its longitudinal axis lying in a plane generally perpendicular to said rear wall and in said second position lying in a plane generally parallel to said rear wall, and including a housing enclosing said motor, said motor housing being disposed in general alignment with said end walls, and including first skid means underlying said material gathering means for directing material to said rear wall, and second skid means supporting said motor housing laterally of said first skid means.

49. The device of claim 48, wherein said device is a snow thrower and said electric motor means is a universal electric motor.

50. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, and comprising a rotor housing including a pair of spaced apart opposed end walls and a rear wall with a material receiving opening opposite said rear wall, material gathering means rotatably mounted between said end walls and adapted to gather material presented to it from said receiving opening and propel it rearwardly and upwardly along said rear wall, electric motor means operatively connected with said material gathering means for rotating same, said handle means in said first operative position having its longitudinal axis lying in a plane generally perpendicular to said rear wall and in said second position lying in a plane generally parallel to said rear wall, and wherein said rear wall is reversible so as to be selectively capable of directing gathered material in opposite directions, said electric motor means being a reversible motor adapted to selectively turn said gathering means in the direction needed to propel gathered material against said rear wall.

51. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, and comprising a rotor housing including a pair of spaced apart opposed end walls and a rear wall with a material receiving opening opposite said rear wall, an elongate rotor rotatably mounted between and supported by said end walls for rotation about its longitudinal axis, paddle means mounted on said rotor for gathering material and propelling it rearwardly and upwardly along the face of said rear wall, an electric motor mounted laterally of and in general alignment with said rotor and having a motor shaft parallel to the axis of rotation of said motor, a circular gear carried by said rotor having internal gear teeth on the internal face thereof, a pinion carried by said motor shaft in driving engagement with said gear teeth, a motor housing enclosing said motor and connected with said rotor housing, an opening in the top position of said rotor housing for admitting air to the interior thereof, first wall structure carried by said rotor housing and second wall structure carried by said handle means, said first and second wall structure being cooperatively engaged to support said handle means on said rotor housing, said second wall structure being rotatable relative to said first wall structure to enable said handle means to swing between said first and second operative positions, latch means for releaseably holding said handle means in each of said operative positions, at least a portion of said handle means being tubular and extending upwardly from said motor housing, an opening in the upper end of said handle portion to admit air thereto, said tubular portion being in communication with said opening in said rotor housing deliver said air thereto.

52. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, and including means for transmission of power from said powering means to said tool means, said tool means including a rotatable member which rotates about a given axis, the longitudinal axis of said handle means in said first position lying in a plane substantially perpendicular to said axis of rotation and in said second operational position lying in a plane substantially parallel to said axis of rotation, and wherein said tool means includes a cylinder rotatable about its longitudinal axis, said cylinder having an inner wall surface comprising a first clutching surface, said transmission means including a gear member having an annular surface insertible in said cylinder in opposing relationship to said inner wall surface and providing a second clutching surface engageable with said first clutching surface.

53. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, and wherein said device is powered by an electric motor, a motor housing enclosing said motor, an opening in said motor housing for admitting air to the interior thereof, said handle means being mounted on said motor housing for movement relative thereto between said operative positions, said handle means being tubular and extending upwardly from said motor housing with the interior passageway thereof in communication with said opening for the passage of air from said passageway through said opening to the interior of said motor housing to cool said motor, an opening in the upper end portion of said handle means for admitting air to said passageway, and said motor housing having a first annular wall enclosing said opening in said motor housing and extending outwardly therefrom, said handle means having a second annular wall which receives and encloses said first annular wall.

54. The device of claim 53, wherein said annular walls provide a pivotal connection between said handle means and said motor housing.

55. The device of claim 54, including a slot in one of said annular walls and a guide member connected with the other of said annular walls for guiding the pivotal movement of said annular walls.

56. The device of claim 55, wherein said handle member pivots about a fixed vertical axis when said rotor housing is in normal ground supported operative position, and including two handle grip members connected with said handle member, said handle grips being perpendicular to each other, one of said grips lying in a plane parallelling the axis of said rotor and the other lying in a plane perpendicular to the axis of said rotor in each of said operative positions.

57. The device of claim 53, wherein said device is a snow thrower and said electric motor is a universal electric motor.

58. A powered device comprising supporting structure, powered tool means supported by said structure having a predetermined operational direction with respect to its own operative components and structural design, means supported by said structure for powering said tool means, and main stem handle means supported by said structure for manually directing the movements of said structure, said handle means having a longitudinal axis, said handle means being movable relative to said tool means between a first position in which said axis lies in a plane which parallels said operational direction and a second position in which said axis lies in a plane which is substantially perpendicular to said operational direction, releaseable latch means holding said handle against movement relative to said tool means in each of said positions, and including snow removing means comprising a rotor housing including end walls and a rear wall, a rotor rotatably mounted between said end walls and forwardly of said rear wall, paddle means mounted on said rotor for gathering snow and throwing it rearwardly and upwardly along said rear wall, a motor housing connected with said rotor housing and movable therewith and located rearwardly of said rear wall with respect to said rotor's relationship to said rear wall, an electric motor mounted in said motor housing for propelling said rotor, means for transmitting driving power from said electric motor to said rotor, said motor housing having an opening therein for admitting air to said motor housing for cooling said motor, an elongate tubular handle member pivotally mounted on said motor housing with the interior passageway thereof in communication with said opening and the interior of said motor housing, said handle member being selectively movable from first operative position in which its axis is perpendicular to the axis of said rotor to second and third operative positions in which its axis lies in a plane paralleling the axis of said rotor, releaseable latch means for holding said handle member against movement in each of said operative positions, said handle member having a lower end adjacent said motor housing and an upper end remote from said motor housing, said handle member having an opening in the upper end portion thereof for receiving air into said passageway for ultimate conveyance to said motor housing through said opening in said motor housing.

* * * * *